United States Patent [19]

Ogawa

[11] Patent Number: 4,558,999

[45] Date of Patent: Dec. 17, 1985

[54] VANE TYPE PUMP DEVICE

[75] Inventor: Hitoshi Ogawa, Himeji, Japan

[73] Assignee: Mitsubishi Denki Kabushiki Kaisha, Tokyo, Japan

[21] Appl. No.: 615,561

[22] Filed: May 31, 1984

[30] Foreign Application Priority Data

Jun. 6, 1983 [JP] Japan ..... 58-87326[U]

[51] Int. Cl.[4] ..... F04C 18/348

[52] U.S. Cl. ..... 418/173

[58] Field of Search ..... 418/164, 172, 173, 174

[56] References Cited

U.S. PATENT DOCUMENTS

| | | | |
|---|---|---|---|
| 1,590,384 | 6/1926 | Kucher | 418/100 |
| 1,834,509 | 12/1931 | Trumble | 418/135 |
| 2,157,120 | 5/1939 | Curtis | 418/173 |
| 2,241,824 | 5/1941 | Meyerhoefer | 418/173 X |
| 4,479,763 | 10/1984 | Sakamaki et al. | 418/144 |

*Primary Examiner*—Leonard E. Smith

*Attorney, Agent, or Firm*—Oblon, Fisher, Spivak, McClelland & Maier

[57] ABSTRACT

A vane type pump device comprising a frame, a shaft rotatably supported by the frame, a rotor secured to the shaft, a plurality of vanes slidably inserted in the rotor in the radial direction, a housing having a cylindrical inner surface whose center is deflected from the axial center of the shaft and an intake port and a discharging port formed in the housing wherein a casing having a cylindrical inner surface with which the vanes are slidably in contact, is rotatably placed between the cylindrical inner surface of the housing and the rotor with the center being coaxial with that of the housing, and the intake port is communicated with the discharging port through an air passage formed between the housing and the casing and a working chamber formed between the casing and the rotor.

6 Claims, 4 Drawing Figures

VANE TYPE PUMP DEVICE

The present invention relates to a vane type pump device. More particularly, it relates to such a device having an improved fluid passage for compression.

A conventional pump device of this kind will be described with reference to FIGS. 1 and 2, in which the reference numeral 1 designates a frame of an electric machine such as an a.c. generator for cars or a motor, the numeral 2 designates a shaft supported by the frame 1 through bearings 3 to be driven by the generator or the motor. A rotor 4 is fixed to the shaft by means of a spline groove 2*a* formed at one end of the shaft 2. The rotor 4 is provided with a plurality of radially extending grooves (three grooves in this embodiment) in which vanes 5 are respectively inserted in the grooves so as to be slidable in the radial direction. A housing 6 having a cylindrical inner surface whose center is deflected from the center of the rotor 4 is secured to the frame 1 with use of fitting bolts 7. The numeral 8 indicates a packing member for sealing placed between the housing 6 and the frame 1 and the numeral 9 designates an oil-sealing member which is fitted to the frame 1 to be in slide-contact with the shaft 2 to thereby maintain airtightness of a working chamber 10 of the pump device. In the housing 6, there are formed an inlet port 11, a discharging port 12 and an oil-feeding port 13 which are respectively connected to a vacuum tank, an oil pan and an oil pump (not shown in the drawing).

The operation of the conventional pump device will be described.

When the shaft 2 is rotated in the direction of the arrow mark A, the vanes 5 project outward due to centrifugal force imparted to the vanes while they are in slide-contact with the inner surface of the housing 6 during the rotation of the rotor. The rotation of the vanes sucks air through the intake port 11 and discharges the air through the discharging port 12; thus a pumping function is performed. Oil fed into the housing 6 through the oil-feeding port 13 gives lubrication on the sliding surface between the vanes 5 and rotor 4, thereafter the oil is discharged into the oil pan from the discharging port 12.

In the conventional vane type pump device having the construction as above-mentioned, when the pump device is operated at a high speed and under oilless condition, the top of the vanes excessively wears due to friction taking place between the inner surface of the housing and the vanes. In this case, if the vanes are made of carbon the top portion of the vanes being in slide-contact with the inner surface of the housing, may be broken by weakened bonding strength of the carbon molecules of the vanes because of production of a high frictional heat, whereby the performance of the pump device is reduced owning to increase in clearance between parts of the pump device due to their thermal expansion and the frictional heat adversely affects the parts of the generator or the motor on which the pump device is mounted. The problems as above-mentioned prevent the operations of the pump device at a high speed and under oilless condition.

It is an object of the present invention to provide a vane type pump device for minimizing production of frictional heat to eliminate the disadvantages of the conventional device.

It is another object of the present invention to provide a vane type pump device having a casing being rotatable in the housing to reduce the relative speed of the top of the vanes to the housing wherein a fluid is passed through an air gap between the housing and the casing to cool the casing thereby to allow the operation of the pump device at a high speed and under oilless condition.

The foregoing and the others objects of the present invention have been attained by providing a vane type pump device comprising a frame, a shaft rotatably supported by the frame, a rotor secured to the shaft, a plurality of vanes slidably inserted in the rotor in the radial direction, a housing having a cylindrical inner surface whose center is deflected from the axial center of the shaft and an intake port and a discharging port formed in the housing, characterized in that a casing having a cylindrical inner surface with which the vanes are slidably in contact, is rotatably placed between the cylindrical inner surface of the housing and the rotor with the center being coaxial with that of the housing, and the intake port is communicated with the discharging port through an air passage formed between the housing and the casing and a working chamber formed between the casing and the rotor.

A more complete appreciation of the invention and many of the attendant advantages thereof will be readily obtained as the same becomes better understood by reference to the following detailed description when considered in connection with the accompanying drawings, wherein.

Figure 1:
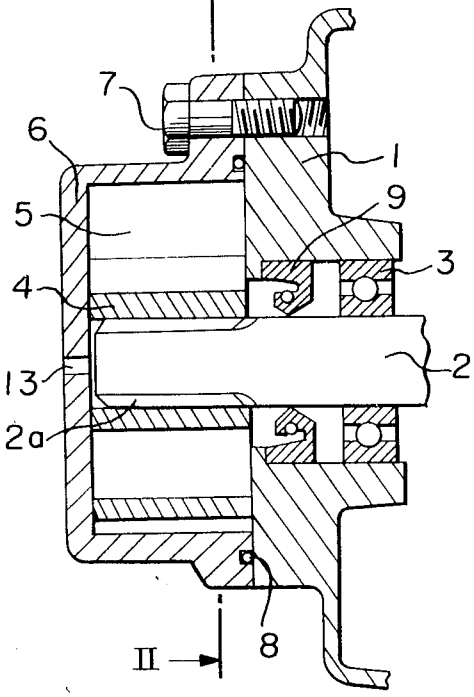
FIGURE 1 PRIOR ART
FIG. 1 is a longitudinal cross sectional view of a conventional vane type pump device.
Figure 2:
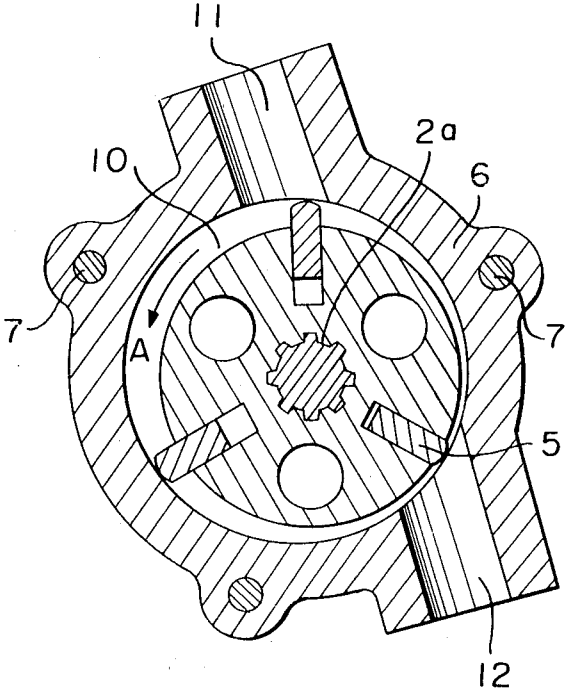
FIGURE 2 PRIOR ART
FIG. 2 is a cross sectional view taken along the line II—II in FIG. 1.
Figure 3:
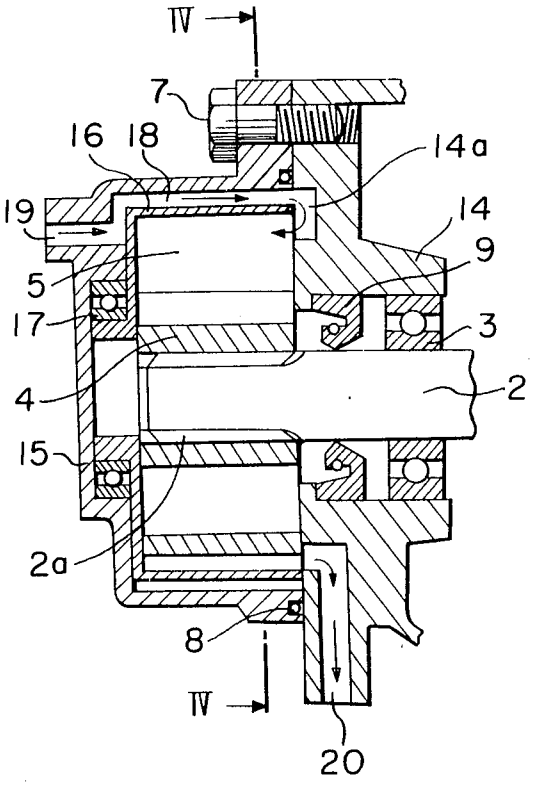
FIG. 3 is a longitudinal cross sectional view of an embodiment of the vane type pump device according to the present invention.
Figure 4:
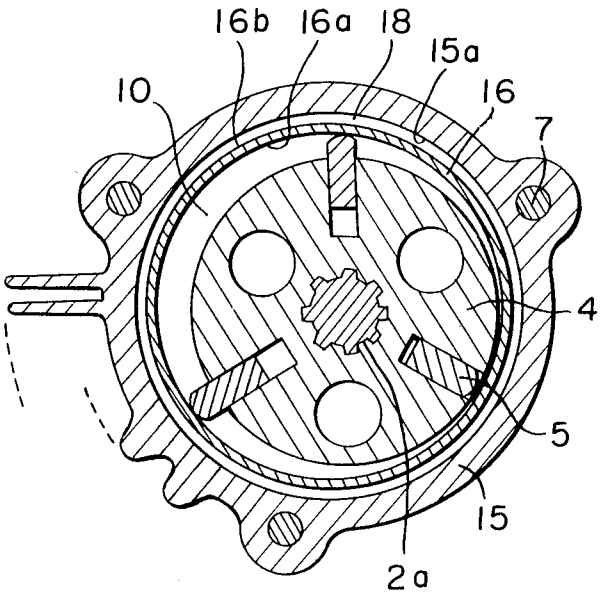
FIG. 4 is a cross sectional view taken along the line IV—IV in FIG. 3.

An embodiment of the present invention will be described with reference to FIGS. 3 and 4 in which the same reference numerals designate the same or corresponding parts and description of the parts is, therefore, omitted.

In a frame 14 of a generator or a motor, a communication hole 14*a* is formed at a side opposing to a housing 15. There is formed in the side surface of the frame 14 a discharging port 20 which is communicated with the working chamber 10 through a passage. The housing 15 having an inner peripheral surface in a cylindrical form is secured to the frame 14 by the fitting bolts 7 so that the center of the cylindrical inner surface is deflected from the axial center of the shaft 2 which is firmly attached with the rotor 4 by means of a spline structure 2*a*. The rotor 4 holds a plurality of vanes 5 in a slidable manner. A casing 16 is rotatably supported by the housing 15 through a roller bearing 17. The outer side surface of the casing 16 extends along the inner wall of the housing 15 with an air gap with which the intake port 19 formed in the top of the housing 15 and the communication hole 14*a* are communicated. The top end of the vanes 5 is made in slide-contact with the inner peripheral surface 16*a* of the casing 16. Thus, there is established an air flow passing from the intake port 19 through the air gap 18, the working chamber 10 to the discharging port 20 as shown by the arrow marks in FIG. 3.

The operation of the pump device according to the present invention will next be described. When the shaft 2 is rotated, centrifugal force acting on the vanes 5 project them in the radial direction so that the vanes 5 are rotated in slide-contact with the inner peripheral surface 16*a* of the casing 16. At the moment, frictional force takes place between the top end of the vanes 5 and the inner peripheral surface 16*a* of the casing 16 to cause rotation of the casing 16 whereby relative speed between the top end of the vanes 5 and the inner peripheral surface 16*a* of the casing 16 is greatly reduced with the result of an increase in the wear property of the vanes 5. The reduction in relative speed also remarkably reduces production of frictional heat. The friction heat is produced due to the differential in rotation between the vanes 5 and the casing 16 at the time of acceleration or change in revolution. Since a substantial amount of the frictional heat is produced in a contacting area between the top end of the vanes 5 and the inner peripheral surface of the casing 16, it can be eliminated by passing the fluid to be pumped through the air gap 18 formed between the inner peripheral wall of the housing 15 and the outer peripheral surface of the casing 16 to cool the casing 16 with the consequence that the wear property of the vanes is improved.

It is possible to further increase cooling effect by forming cooling fins on the cylindrical outer surface of the casing or by forming a corrugated outer surface in the casing to increase its surface area.

In the embodiment above-mentioned, although description has been made as to the casing 16 supported by the housing 15 through the bearing 17, the casing 16 may be supported on the side of the frame 14.

Further, the embodiment above-mentioned referred to a vacuum pump; however, the same effect can be obtained by applying the present invention to a compressor or an air pump actuated by a generator, a motor or another driving source. In addition, the same effect is obtainable by passing the fluid through the air gap 18 between the housing 16 and casing 15 before it is discharged instead of that the fluid is passed just after sucking.

As described above, in the present invention, it is possible to operate the pump device at a high speed and under oilless condition; minimizes change in clearance due to thermal expansion and eliminate the problem of thermal deterioration of the parts of the generator or the motor by cooling the casing.

What is claimed is:

1. A vane type pump device comprising:

a frame, a shaft rotatably supported by said frame, a rotor secured to said shaft, a plurality of vanes slidably inserted in said rotor in the radial direction, a housing having a cylindrical inner surface whose center is offset from the axial center of said shaft, a casing having a cylindrical inner surface with which said vanes are slidably in contact to form working chambers, said casing being freely rotatably mounted between said cylindrical inner surface of said housing and said rotor with a center of said casing being coaxial with that of said housing, and an intake port and a discharging port, said intake port being formed in said housing and being communicated with said discharging port through an air passage formed between said housing and said casing, through a communication hole in said frame, and through said working chambers whereby air sucked through said intake port, said communication hole and said working chambers, is discharged from said discharging port.

2. The vane type pump device according to claim 1, wherein said casing is supported by said housing through a bearing.

3. The vane type pump device according to claim 1, wherein at least one cooling fin is formed on the outer peripheral surface of said casing.

4. The vane type pump device according to claim 1, wherein said casing is provided with a corrugated outer peripheral surface.

5. The device of claim 1, wherein said casing is freely rotatably mounted on said housing via bearing means.

6. The device of claim 5, wherein said bearing means comprise a roller bearing.

* * * * *